US008183961B2

(12) United States Patent
Tzuang et al.

(10) Patent No.: US 8,183,961 B2
(45) Date of Patent: May 22, 2012

(54) COMPLEMENTARY-CONDUCTING-STRIP STRUCTURE FOR MINIATURIZING MICROWAVE TRANSMISSION LINE

(75) Inventors: Ching-Kuang Tzuang, Taipei (TW); Meng-Ju Chiang, Taipei (TW); Shian-Shun Wu, Taipei (TW)

(73) Assignees: National Taiwan University, Hsinchu (TW); CMSC, Inc., Hsinchu (TW)

( * ) Notice: Subject to any disclaimer, the term of this patent is extended or adjusted under 35 U.S.C. 154(b) by 791 days.

(21) Appl. No.: 12/329,120

(22) Filed: Dec. 5, 2008

(65) Prior Publication Data

US 2010/0141359 A1 Jun. 10, 2010

(51) Int. Cl.
*H01P 3/08* (2006.01)

(52) U.S. Cl. ..... 333/238; 333/246; 333/161; 333/120

(58) Field of Classification Search ..... 333/161, 333/236, 238, 239, 242, 243, 246, 247, 120; 257/664, 728

See application file for complete search history.

(56) References Cited

U.S. PATENT DOCUMENTS 5,408,053 A * 4/1995 Young ..... 174/264

OTHER PUBLICATIONS

Meng-Ju Chiang, Hsien-Shun Wu, Ching-Kuang C. Tzuang; Design of Synthetic Quasi-TEM Transmission Line for CMOS Compact Integrated Circuit; IEEE Transactions on Microwave Theory and Techniques, vol. 55, No. 12, Dec. 6, 2007; p. 2512-2520; Scottsdale, ZA, USA.

* cited by examiner

*Primary Examiner* — Benny Lee
*Assistant Examiner* — Gerald Stevens
(74) *Attorney, Agent, or Firm* — WPAT., P.C.; Justin King

(57) ABSTRACT

The present invention provides a complementary-conducting-strip (CCS) structure for miniaturizing microwave transmission line. The CCS structure comprises a substrate; a transmission part formed on the substrate, the transmission part consisted of M metal layers and at least one connecting arm extending from the metal layers to connect to an adjacent CCS structure, the M metal layers interlaminated M−1 dielectric layer(s) perforating a plurality of first metal vias to connect the M metal layers, wherein M≧2 and M is a nature number; and a frame part formed on the substrate, the frame part surrounding the transmission part and consisted of M−1 metal frame(s), the M−1 metal frame(s) interlaminated M−2 dielectric frame(s) perforating a plurality of second metal vias to connect the metal frames.

12 Claims, 15 Drawing Sheets

TABLE 1

Numerical Designs of 10.0 GHz Coplanar-Waveguide-Connected-Stub Transmission Lines (CCS TLs)

Using Conservative 0.18 μm 1P6M CMOS Technology

| Type | Re(Z$_0$) (Ω) | P (μm) | W$_G$ (μm) | S (μm) | W (μm) | Signal Trace M$_1$ | M$_2$ | M$_3$ | M$_4$ | M$_5$ | M$_6$ | Mesh Ground M$_1$ | M$_2$ | M$_3$ | M$_4$ | M$_5$ | Q | SWF |
|---|---|---|---|---|---|---|---|---|---|---|---|---|---|---|---|---|---|---|
| CCS TL (W$_G$ = 0) | 104.0 | 30.0 | 29.5 | 2.0 | 2.0 | | | | | | ■ | ■ | | | | | 3.15 | 2.03 |
| | 98.1 | 20.0 | 19.5 | 2.0 | 2.0 | | | | | | ■ | ■ | | | | | 3.13 | 1.82 |
| | 95.6 | 15.0 | 14.5 | 2.0 | 2.0 | | | | | | ■ | ■ | | | | | 3.05 | 1.70 |
| | 92.6 | 10.0 | 9.5 | 2.0 | 2.0 | | | | | | ■ | ■ | | | | | 2.74 | 1.48 |
| | 91.9 | 20.0 | 14.5 | 2.0 | 2.0 | | | | | | ■ | ■ | | | | | 3.50 | 1.82 |
| | 88.1 | 4.0 | 3.5 | 2.0 | 2.0 | | | | | | ■ | ■ | | | | | 1.93 | 0.97 |
| | 71.8[1] | 30.0[1] | 28.0[1] | 4.0[1] | 4.0[1] | | | | | | ■ | ■ | ■ | | | | 4.03[1] | 2.03[1] |
| | 69.2 | 5.0 | 4.0 | 2.0 | 2.5 | | | | | | ■ | ■ | ■ | ■ | | | 2.27 | 1.24 |
| | 65.8 | 30.0 | 28.0 | 4.0 | 4.0 | | | | | | ■ | ■ | ■ | ■ | ■ | ■ | 5.19 | 2.25 |
| | 64.7[1] | 30.0[1] | 28.0[1] | 4.0[1] | 5.0[1] | | | | | | ■ | ■ | ■ | ■ | ■ | ■ | 5.24[1] | 2.27[1] |
| | 50.7 | 10.0 | 7.0 | 3.5 | 3.5 | | | | | | ■ | ■ | ■ | ■ | ■ | ■ | 3.17 | 1.97 |
| | 36.0 | 15.0 | 10.0 | 6.0 | 9.0 | | | | | | ■ | ■ | ■ | ■ | ■ | ■ | 3.62 | 2.15 |
| | 34.1 | 15.0 | 10.5 | 6.0 | 6.0 | | | | | | ■ | ■ | ■ | ■ | ■ | ■ | 3.38 | 2.37 |
| | 35.1 | 30.0 | 20.0 | 10.0 | 10.0 | | | | | | ■ | ■ | ■ | ■ | ■ | ■ | 4.97 | 2.51 |
| | 34.3 | 30.0 | 25.0 | 10.0 | 12.0 | | | | ■ | ■ | ■ | ■ | ■ | ■ | ■ | ■ | 4.77 | 2.64 |
| | 30.7 | 30.0 | 26.0 | 10.0 | 14.0 | ■ | ■ | ■ | ■ | ■ | ■ | ■ | ■ | ■ | ■ | ■ | 4.63 | 2.76 |
| | 22.7 | 30.0 | 22.0 | 14.0 | 16.0 | | | | | ■ | ■ | ■ | ■ | ■ | ■ | ■ | 4.03 | 2.67 |
| | 12.4 | 10.0 | 5.0 | 4.0 | 4.0 | ■ | ■ | ■ | ■ | ■ | ■ | ■ | ■ | ■ | ■ | ■ | 2.03 | 4.79 |
| | 8.62 | 30.0 | 17.0 | 14.0 | 16.0 | ■ | ■ | ■ | ■ | ■ | ■ | ■ | ■ | ■ | ■ | ■ | 1.97 | 4.18 |
| CCS TL (W$_G$=0, S=W) or TTMS | 88.1 | / | 0 | 2.0 | 2.0 | | | | | | ■ | ■ | | | | | 2.07 | 0.96 |
| | 69.2 | / | 0 | 4.0 | 4.0 | | | | | | ■ | ■ | | | | | 2.93 | 1.09 |
| | 50.7 | / | 0 | 8.0 | 8.0 | | | | | | ■ | ■ | | | | | 3.58 | 1.21 |
| | 35.8 | / | 0 | 16.0 | 16.0 | | | | | | ■ | ■ | | | | | 4.21 | 1.49 |
| | 22.7 | / | 0 | 30.0 | 30.0 | | | | | | ■ | ■ | | | | | 4.42 | 1.62 |

[1] design parameters and extracted results in Fig. 3.

[2] design parameters applied in Fig. 7(a).

FIG. 4

DESIGN GUIDELINES OF CMOS COMPLEMENTARY-CONDUCTING-STRIP TRANSMISSION LINE (CCS TL)

| | $P/W_s$ ↑ | $S$ ↑ | $W_s/W$ ↑ | # Metal Layer ↑ |
|---|---|---|---|---|
| $Z_c$ | ↓ | ↓ | ↓ | ↓ |
| $Q$ | ↑ | ↑ | ↑ | ↑ |
| SWF | ↓ | ↑ | ↓ | ↑ |
| AMD | ↑ | ↑ | ↑ | ↑ |

COMPLEMENTARY-CONDUCTING-STRIP STRUCTURE FOR MINIATURIZING MICROWAVE TRANSMISSION LINE

BACKGROUND OF THE INVENTION

1. Field of the Invention

This invention relates to a complementary-conducting-strip (CCS) structure (or waveguide cell) to construct a waveguide array structure for transmission line circuit design, the CCS structure is formed by integrated circuit process to accomplish a miniaturized microwave monolithic circuit.

2. Description of the Related Art

Integrating monolithic electronic circuits or miniaturizing a system on a chip is a tendency on integrated circuit design; however, miniaturizing a microwave communication system is not easy, because large amounts of distributed elements are employed in microwave circuits. Even though a lot of the elements are miniaturized, transmission lines in microwave usually take a large area of the circuits.

Monolithic microwave integrated circuits (MMICs) made by GaAs technology had often extensively used two distinct transmission lines (TLs) structures: 1) microstrip line (MSL) with backside metallization and via holes, and 2) coplanar waveguide (CPW) with air bridges. III-V compounds such as GaAs semiconductor technology have superior electrical performance to silicon-based processes, like CMOS and SiGe BiCMOS, due to their higher electron mobility, higher breakdown voltage, and the ability of making high quality factor (Q-factor) passive components. With continuing evolution in process and technology, silicon-based technologies, however, promise a higher level of integration and lower cost than the III-V counterparts, thus making a multifunction RF transceiver or an RF system-on-chip (SOC) a reality.

In the present, more and more electrical engineers miniaturize monolithic circuit in microwave through complementary metal oxide semiconductor (CMOS) technology. CMOS technology promises a higher level of integration and lower cost, enabling the production of multifunction wireless transceivers and communication system on single chip design. The transmission line frameworks in CMOS technology also satisfied broadside-coupler, co-planar waveguide (CPW) and meandering solutions. Moreover, microwave transmission elements would be accomplished in a three-dimensional monolithic microwave integrated circuit (3D MMIC) in order to save area of a chip. The concept of synthetic quasi transverse electromagnetic (quasi-TEM) transmission line successfully employed to miniaturize RF integrated circuits in the highest degree.

Extensive studies indicate that the synthetic quasi-TEM transmission line has better guiding properties than those of the conventional micro strip when the signal trace is meandered in a two-dimensional plane. Following the same concept of miniaturization, this work focuses on the design of the quasi-TEM transmission line using standard 0.18 μm 1P6M CMOS technology, which is available from most standard silicon foundry services in the world.

SUMMARY OF THE INVENTION

The present invention disclosed a CCS structure (or waveguide cell) for miniaturizing microwave circuits, wherein the CCS structures are arrayed in rows and columns to construct a larger two-dimensional waveguide structure, then a synthetic quasi transverse electromagnetic (quasi-TEM) transmission line is built through the two-dimensional waveguide structure. This CCS structure of the invention presents the design guidelines of the quasi-TEM transmission line with examples that based on the standard of complementary metal-oxide-semiconductor (CMOS) process technology. The synthetic quasi-TEM transmission line is composed of five structural parameters to synthesize its guiding characteristics and the design is presented with the following unique attributes, a bigger characteristic impedance range, enhance the value of slow-wave factor (SWF) for miniaturization, the ratio of the area of the quasi-TEM transmission line to its corresponding quality factor Q can help to estimate the cost of the loss for the circuit miniaturizations.

An embodiment of the present invention discloses a CCS structure which comprises a substrate; a transmission part formed on the substrate, the transmission part consisted of M metal layers and at least one connecting arm extending from the metal layers to connect to an adjacent CCS structure, said the M metal layers interlaminated M−1 dielectric layer(s) perforating a plurality of first metal vias to connect the M metal layers, wherein $M \geqq 2$ and M is a nature number; and a frame part formed on the substrate, the frame part surrounding the transmission part and consisted of M−1 metal frame(s), the M−1 metal frame(s) interlaminated M−2 dielectric frame(s) perforating a plurality of second metal vias to connect the metal frames.

Another embodiment of the present invention provides a CCS structure that comprises a substrate; a transmission part formed on the substrate, the transmission part consisted of M metal layers interlaminating M−1 dielectric layers perforating plurality of first metal vias to connect the M metal layers, the transmission part comprising a plurality of connecting arms extending from both the top and the middle of the metal layers to join adjacent CCS structures, wherein $M \geqq 4$ and M is a nature number; two frame parts surrounding the middle and the bottom of the transmission part to clamp the middle connecting arms, each of the frame part consisted of M−2 metal frames interlaminating corresponding dielectric frames perforating a plurality of second metal vias to connect the metal frames; and a dielectric material being between the transmission part and the two frame parts, wherein the dielectric material surrounds the lower connecting arms.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 4 shows a table for reference designs of 10.0 GHz CCS transmission line using standard 0.18 μm 1P6M CMOS process technology;

DETAILED DESCRIPTION OF THE PREFERRED EMBODIMENTS

Figure 1A:
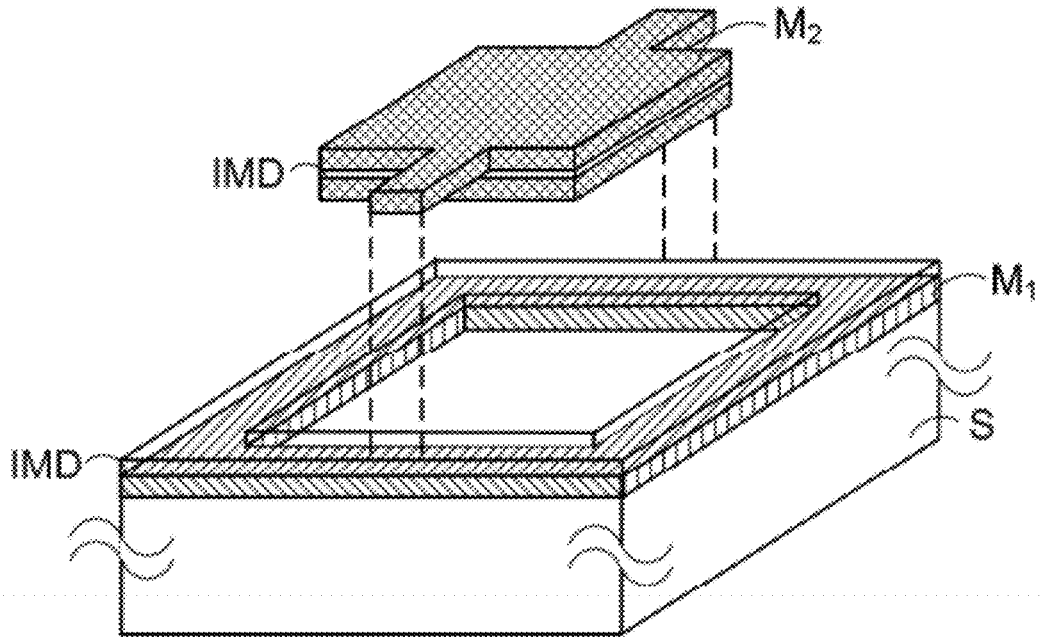
FIG. 1A illustrates a preferred CCS structure embodiment in three-dimensional view.

What is probed into the invention is a CCS structure (or three-dimensional waveguide cell). Detail descriptions of the structure and elements will be provided as followed in order to make the invention thoroughly understood. The application of the invention is not confined to specific details familiar to those who are skilled in the art. On the other hand, the common structures and elements that are known to everyone are not described in details to avoid unnecessary limitation of the invention. Some preferred embodiments of the present invention will now be described in greater detail as followed. However, it should be recognized that the present invention can be practiced in a wide range of other embodiments besides those explicitly described, that is, this invention can also be applied extensively to other embodiments, and the scope of the present invention is expressly not limited except as specified in the accompanying claims.

The invention proposes a complementary-conducting-strip (CCS) structure for miniaturizing microwave circuits, wherein the CCS structures are arrayed in row and column to construct a larger two-dimensional waveguide structure, then a synthetic quasi transverse electromagnetic (quasi-TEM) transmission line is built through the two-dimensional waveguide structure. In this invention the synthetic quasi-TEM transmission line is also called a complementary-conducting-strip (CCS) transmission line that is base on its character. The CCS structure in embodiments also provide a guideline for designing a CCS transmission line by following the standard of complementary metal-oxide-semiconductor (CMOS) process technology with 0.18 μm one-poly and six-metal (1P6M) process.

One of the features of this invention is the structure of the CCS. The CCS structure in a transmission line is not only for miniaturizing on microwave design but also alters characteristics impedance of the transmission line on synthetic quasi-TEM. The CCS structure comprises a substrate, a transmission part and a frame part. The transmission part consists of M metal layers interlaminated M−1 dielectric layer(s) perforating a plurality of first metal vias to connect the M metal layers. Wherein M≧2 and M is a nature number.

The transmission part of the CCS structure is for transmitting signals, wherein the transmission part further comprises at least one connecting arm extending from the top metal layer for joining the adjacent CCS structures. There are three connection situation: (A) The connecting arms may be two for joining the adjacent or opposite of two CCS structures. (B) The connecting arms may be three and shape into a T-shape for joining three adjacent of CCS structures. (C) The connecting arms may be four and shape into a cross for joining four adjacent of CCS structures. When the CCS structures are arrayed in rows and columns to form a larger two-dimensional waveguide structure, a CCS transmission line is built up and meandered by joining the connecting arms of the transmission parts of the CCS structures.

The frame part of the CCS structure is on the substrate and surrounds the transmission part, wherein the frame structure is for a ground plane and consists of M−1 metal frames; again M is a nature number and M≧2. The M−1 metal frames interlaminate M−2 dielectric frame(s) perforating a plurality of second metal vias to connect the M−1 metal frames. Space between the transmission part and the frame part is filled with dielectric material for isolation each other. Now referring to FIG. 1A the CCS structure is in the situation of M=2, therefore the transmission part ($M_2$) has two metal layers with two connecting arms and the frame part ($M_1$) has one metal frame layer. Both the frame part ($M_1$) and the transmission part ($M_2$) are on a substrate (S) and a dielectric material (IMD) is between the metal layers and top of the frame part.

In the same level, means the same layer in CMOS process, of the CCS structure, the dielectric layer between the metal layers would merge the dielectric frame between the frame layers to a dielectric plane during both the dielectric layer and the dielectric frame are the same material. The dielectric plane also perforates a plurality of the first and the second metal vias for connecting each metal layer and each metal frame, respectively.

Figure 1B:
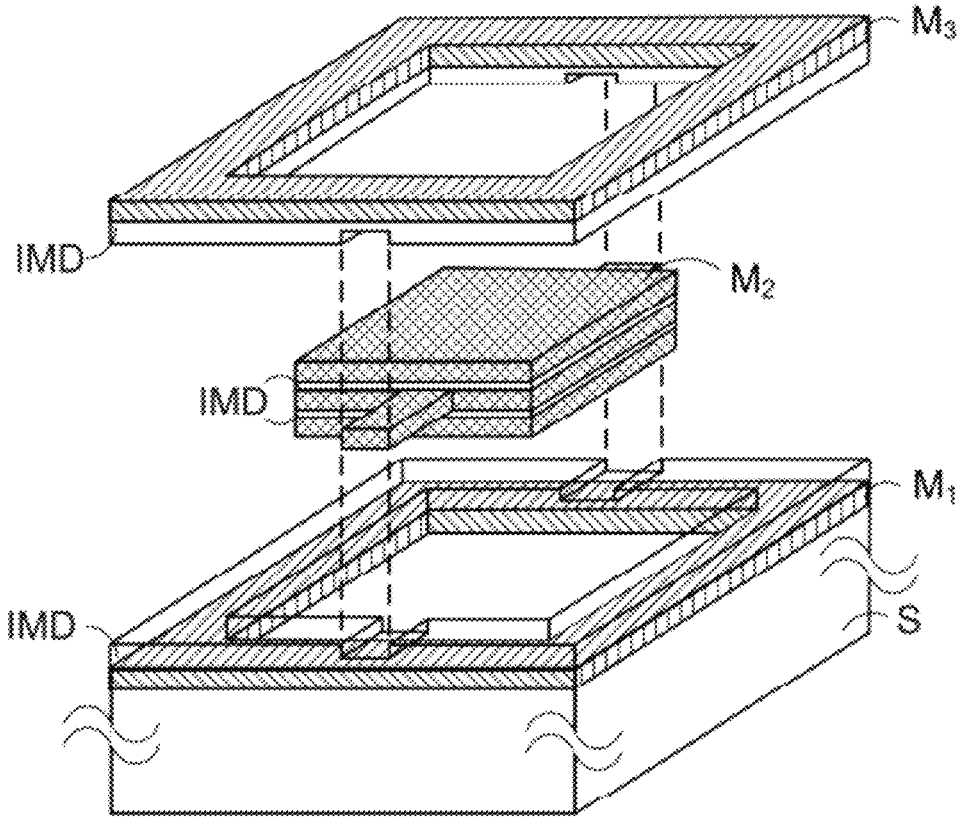
FIG. 1B illustrates another preferred CCS structure embodiment in three-dimensional view.
Figure 1C:
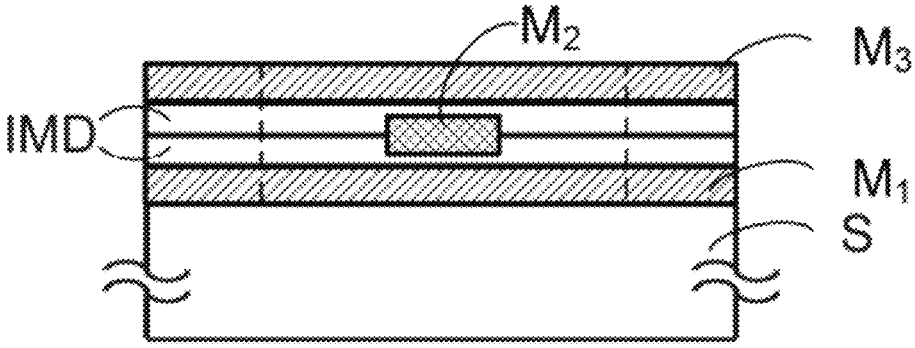
FIG. 1C illustrates the preferred CCS structure shown in FIG. 1B on side view.

Another structure of the CCS is shown in FIG. 1B and comprises a transmission part ($M_2$), two frame parts ($M_1$ & $M_3$) and a substrate (S), wherein the transmission part further comprises at least one connecting arm which is extending from a middle metal layer for joining the adjacent CCS structure. The transmission part ($M_2$) is for transmitting signals and the frame parts ($M_1$ & $M_3$) are for a ground plane. The two frame parts ($M_1$ & $M_3$) surround the top and the bottom of the transmission part ($M_2$) and clamp the connecting arms. There are a layer of dielectric material (IMD) on each of the two frame parts ($M_1$ & $M_3$) for isolating the connecting arms ($M_2$) from the frame parts ($M_1$ & $M_3$) which is also shown in FIG. 1C, but the IMD frames between $M_1$ & $M_3$ are perforating a plurality of metal vias to connect $M_1$ & $M_3$ for a ground plane.

In the same structure, the transmission part may consist of M metal layers, M is nature number and M≧3, and the total of all the metal frames is M−1 by the two frame structures. A CCS transmission line is built by the CCS structure, and the transmission line is an application on a strip line structure. A meandered CCS transmission line is built through joining the connecting arms of the transmission parts of the CCS structures. There are three ways of the connecting arms: (A) The connecting arms are for two to join the two adjacent or opposite CCS structures. (B) The connecting arms are for three and shape into letter T to join three adjacent CCS structures. (C) The connecting arms are for four and shape into a cross to join four adjacent CCS structures.

Figure 1D:
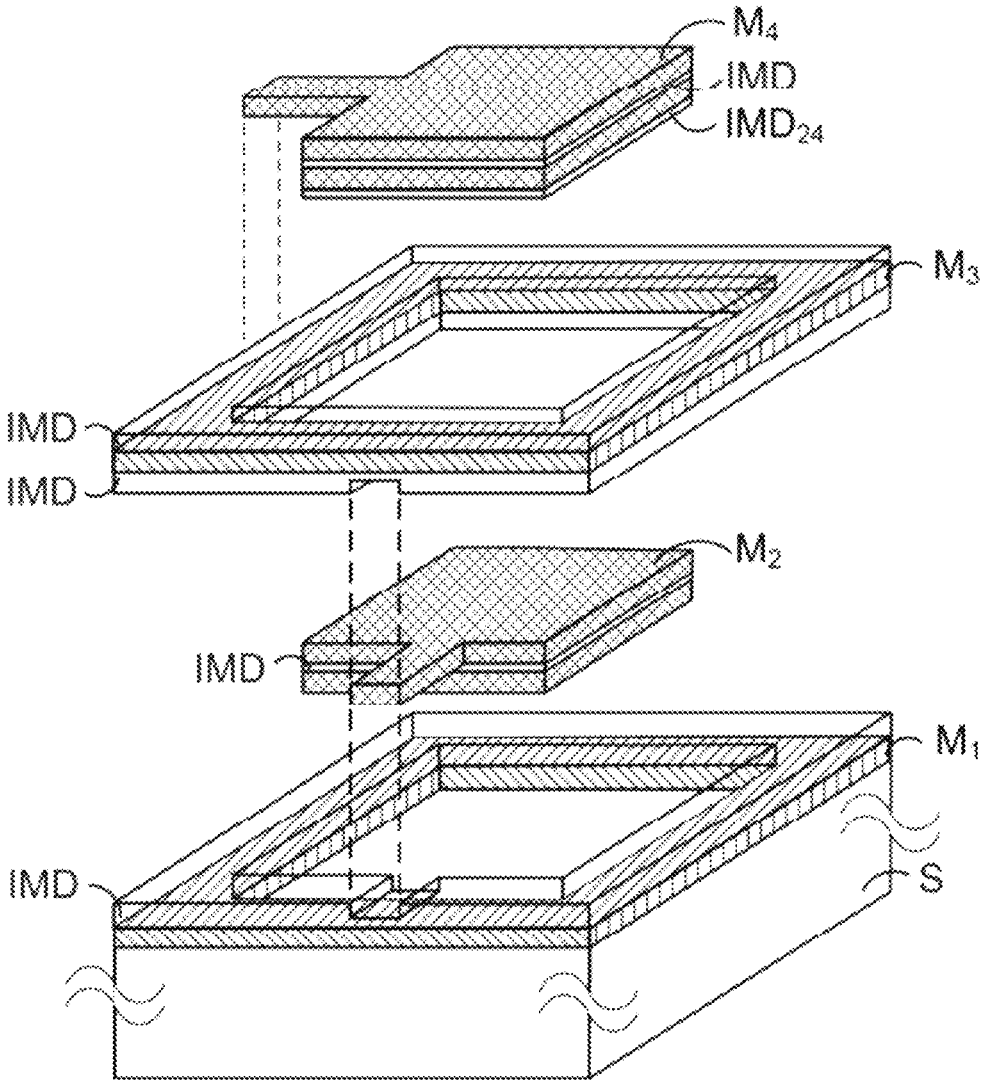
FIG. 1D shows the third preferred CCS structure embodiment in three-dimensional view.
Figure 1E:
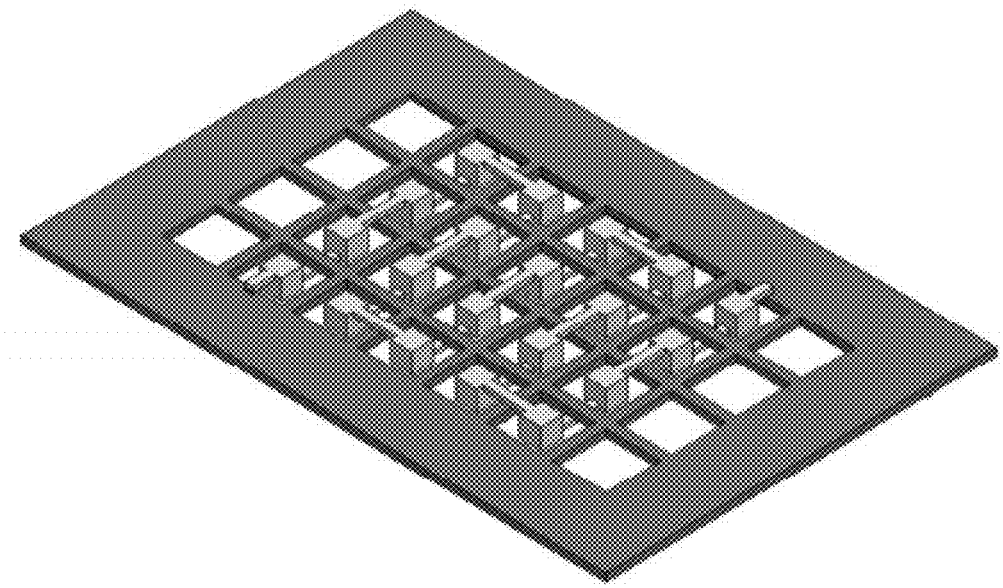
FIG. 1E illustrates a preferred CCS transmission line embodiment built by a plurality of CCS structure shown in FIG. 1D.

According to above two kinds of CCS structures, the third structure of the CCS would be inferred that comprises both the first and second structure characters. In the third structure, the transmission part consists of M metal layers, M is nature number and M≧4 and comprises a plurality of connecting arms which extend from both top and middle of the metal layers for joining the adjacent CCS structures. There are two frame parts to surround the middle and the bottom of the transmission part and to clamp the middle connecting arms. Referring to FIG. 1D, what is shown is an example based on the third structure, the transmission part is combined by $M_2$ & $M_4$, $M_2$ & $M_4$ are two smaller transmission parts using double metal layers and having either $M_2$ or $M_4$ (or both) with one connecting arm. $M_2$ combines $M_4$ to be the transmission part via $IMD_{24}$ layer which is also a dielectric material layer perforating plurality of metal vias as others IMD layers. There are three ways to join the adjacent CCS structures by the connecting arms as above-mentioned. As what is shown in FIG. 1E, the third structures are arrayed in rows and columns to build a meandered CCS transmission line, not only in plane but also in a three-dimensional space.

Figure 1F:
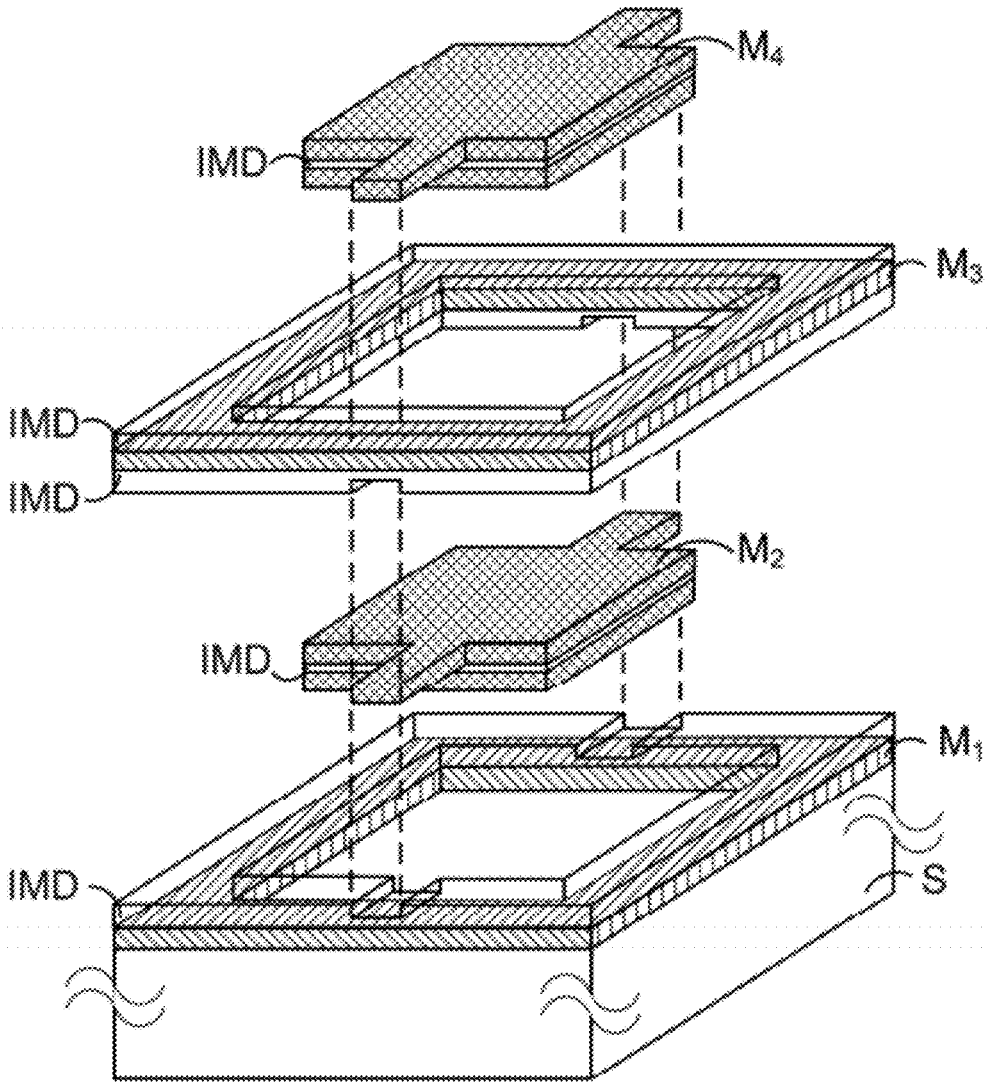
FIG. 1F depicts the fourth preferred CCS structure embodiment that is able to build up two transmission lines.

Referring back to FIG. 1D, if $M_2$ is without the $IMD_{24}$ layer then $M_4$ would be not connected with M2, the original transmission part is altered to be two independent transmission structures as what is shown in FIG. 1F. It is possible for the third structure transfers to a new structure of FIG. 1F for transmitting two independent signals by $M_2$ & $M_4$ in the same CCS structure. When the new structures are arrayed in rows and columns to build double CCS transmission lines by $M_2$ & $M_4$ of the CCS structure, the two transmission lines may be parallel in the same structure as shown in FIG. 1F or cross each other but without intersection, it depends on the transmission line direction and which way the new structure to join the adjacent CCS structures.

The invention disclosed that arraying the CCS structures to build a CCS transmission line through their three-dimensional structure. It is not only miniaturizing prior microwave circuits but also reduces CCS transmission line characteristics impedance Zc and increases its corresponding quality factor (Q factor) value. In micro electronics circuits, each CCS structure is corresponding to an inductance element and the connecting arm joining the adjacent CCS structure is corresponding to a capacitance for constructing a two-dimensional L-C waveguide array. The invention utilizes adjusting the parameters of the CCS structure to alter its characteristics impedance Zc and Q factor of the CCS transmission line and the CCS structure is accomplished by multilayer circuit or monolithic circuit process.

The invention also disclosed the design guidelines of the synthetic quasi transverse electromagnetic (quasi-TEM) transmission line via a two-dimensional waveguide cell array structure. In the embodiment of the invention, the array structure uses a standard of 0.18 μm one-poly six-metal (1P6M) complementary metal-oxide-semiconductor (CMOS) process technology. The following paragraphs illustrates how to build a quasi-TEM transmission line by the first type CCS structure and what affects the value of characteristics impedance Zc & slow wave-factor (SWF), the other structures would illustrate in the same way.

The synthetic quasi-TEM transmission line in the invention also called the complementary-conducting-strip (CCS) transmission line is composed of five structural parameters to synthesize its guiding characteristics with the following unique attributes. First, a characteristic impedance range of 8.62-104.0Ω is yielded. Second, the maximum value of slow-wave factor (SWF) is 4.79, representing an increase of 139.5% over the theoretical limit of quasi-TEM transmission line. Third, the ratio of the area of the CCS transmission line to its corresponding quality factor Q can help to estimate the cost of the loss for the microwave circuit miniaturizations.

Additionally, the important CMOS manufacturing of metal density is for the first time involved in the reported transmission line designs. By following the proposed design methodologies, a practical design example of Ka-band CMOS rat-race hybrid is reported and experimentally examined in detail to reveal the feasibility of the proposed design guidelines to synthesize the CMOS CCS transmission line. The chip size without contact pads is 420.0 μm×540.0 μm. The measured loss and isolation of the hybrid at 36.3 GHz are 3.84 dB and 58.0 dB, respectively.

Figure 2A:
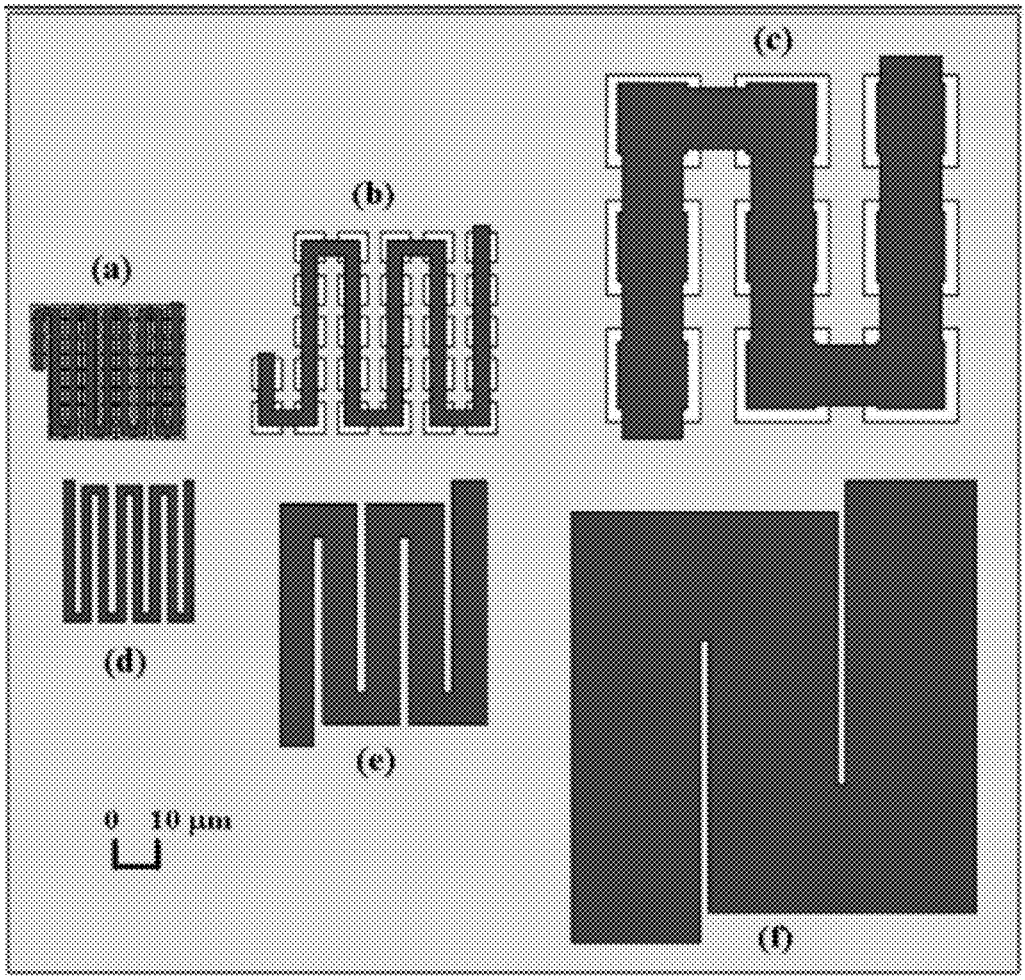
FIG. 2A depicts several preferred CCS transmission lines.

The complementary-conducting-strip (CCS) transmission line, has better guiding properties than those of the conventional microstrip when the signal trace is meandered in a two-dimensional plane. Following the same concept of miniaturization, this invention focuses on the design of the CCS transmission line using standard 0.18 μm 1P6M CMOS process technology, which is available from most standard silicon foundry services in the world. FIG. 2A illustrates two approaches to designing a CMOS CCS transmission line (a) Zc=88.1Ω, (b) Zc=50.7Ω, (c) Zc=22.7Ω, (d) Zc=88.1Ω, (e) Zc=50.7Ω, (f) Zc=22.7Ω. As shown in FIG. 2A, the signal traces of the CCS transmission line are meandered by obeying two basic rules. First, the length of the signal trace is fixed. The length is defined as 270.0 μm in this invention. Second, the CCS transmission line is meandered by at least 4 bends in the square area. By following the winding course defined above, the CCS transmission lines are designed for the characteristics impedance Zc of 88.1Ω, 50.7Ω and 22.7Ω. The CCS transmission lines in the bottom row of FIG. 2A are designed by referring to the concept of thin-film microstrip (TFMS), which is regarded as a special limiting case.

Although all the limiting cases are meandered with a line space of 2.0 μm, which is the minimum value defined in this invention, the corresponding area increases when Zc decreases. For example, the area of 22.7Ω CCS transmission line in FIG. 2A(f) is 10152.0 $\mu m^2$, representing 10.25 occurrences of 88.1Ω CCS transmission line in FIG. 2A (d). However, the CCS transmission line is designed with stacked metal by manipulating the advantage of multilayer CMOS technology. FIGS. 2A(a) and (c) show the 22.7Ω CCS transmission line and 88.1Ω CCS transmission line, which can be designed with areas of 6750.0 $\mu m^2$ and 1019.7 $\mu m^2$, respectively. Conversely, the quality factor Q of the 88.1Ω CCS transmission line in FIG. 2A(a) at 10.0 GHz is 1.97, which is 6.8% lower than that of in FIG. 2A(d). The slow-wave factor (SWF) of the 22.7Ω CCS transmission line in FIG. 2A(b) at 10.0 GHz is 2.67, which is 33.5% higher than the theoretical limit of the quasi-TEM transmission line.

Furthermore, by applying the stacked metal to the designs of 22.7Ω and 50.7Ω CCS transmission lines in FIG. 2A(a) and (b), two CCS transmission lines automatically meet the metal density requirement without inserting additional dummy metals. The metal density, which denotes the ratio of the total metal layout area to the transmission line area, is strongly required by the foundry to manage the variation of chemical-mechanical polishing (CMP) in the wafer manufacture, maintaining the wafer yield and design reliability. The design approaches, which lead to different guiding characteristics of the CCS transmission line, are extensively investigated in design of meandered CMOS CCS transmission line after the validity check of the full-wave electromagnetic simulation, which is presented in the CMOS multilayer synthetic quasi-TEM transmission line for extracting the guiding characteristics of the CMOS CCS transmission line. A practical example of Ka-band rat-race hybrid realized by CCS transmission line, based on the design guidelines summarized to reveal the superior performance in terms of low loss and compact area of the CMOS integration.

Figure 2B:
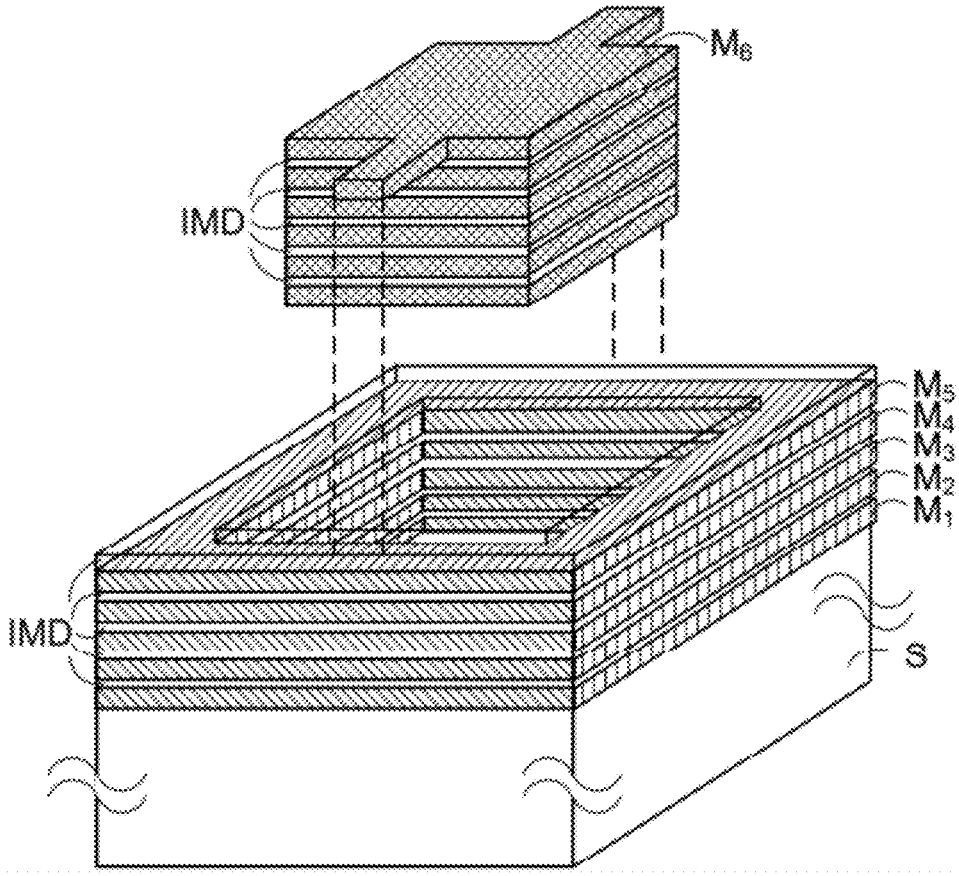
FIG. 2B illustrates a preferred CCS structure embodiment in one-poly and six-metal (1P6M) process in three-dimensional view.

The proposed CCS transmission line is constructed by the unit CCS on the silicon substrate. As shown in FIG. 2B, the unit CCS, whose dimensions are much smaller than the guiding wavelength at the operating frequency, is the smallest element in the transmission line. The signal trace is composed of a central patch and four connecting arms, with the latter used to connect adjacent CCS structures. FIG. 2B only displays two arms for simplicity. However, the central patch and mesh ground plane can be constructed by using solid vias to link metals in a multilayer structure. The thickness of the mesh ground plane is increased by stacking M1 to M5 in order to decrease the series resistance of the transmission line, thus enhancing the quality factor Q of the CCS transmission line.

Figure 2C:
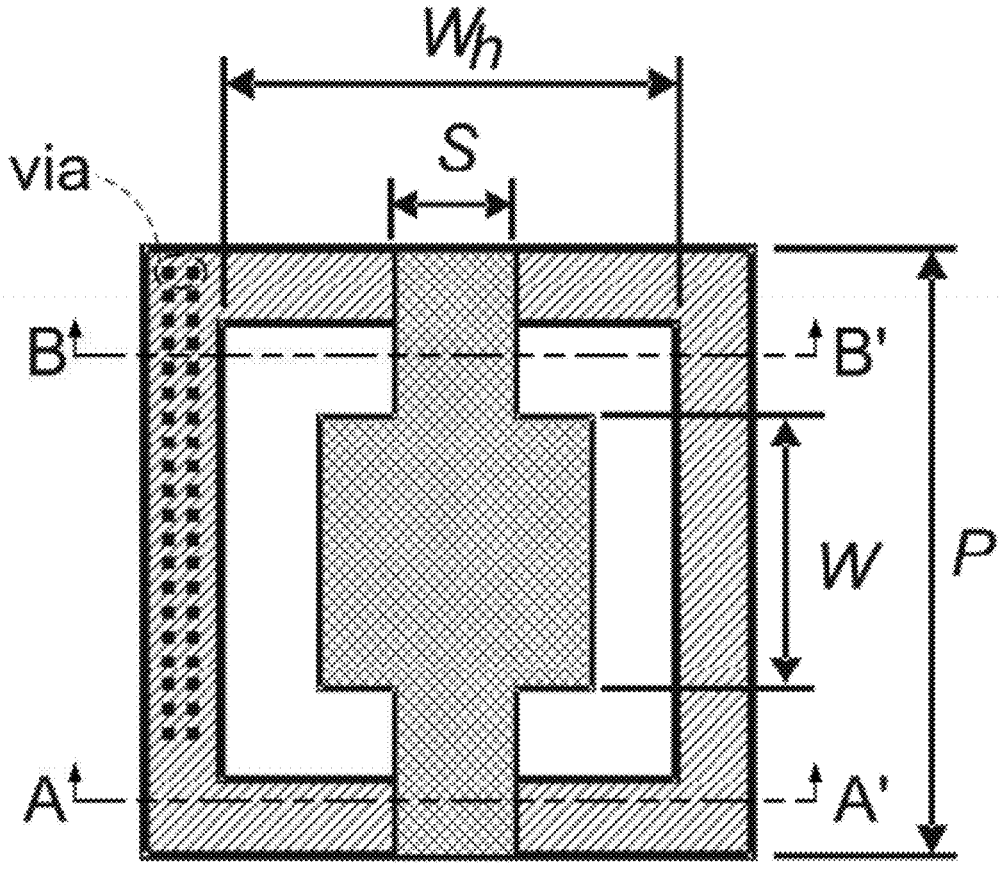
FIG. 2C shows the preferred CCS structure shown in FIG. 2B on top view.
Figure 2D:
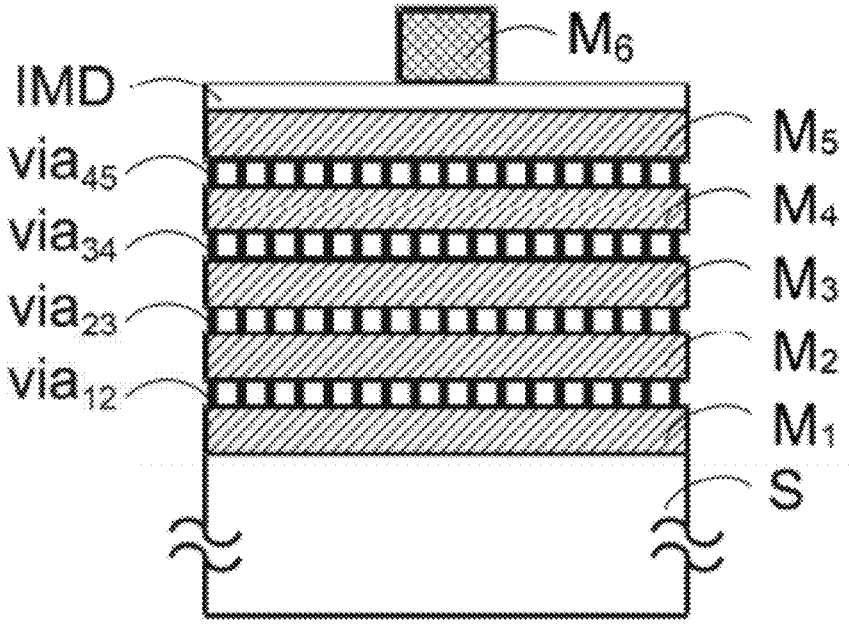
FIG. 2D shows the cross-sectional view from the A-A' line of the preferred CCS structure shown in FIG. 2C.
Figure 2E:
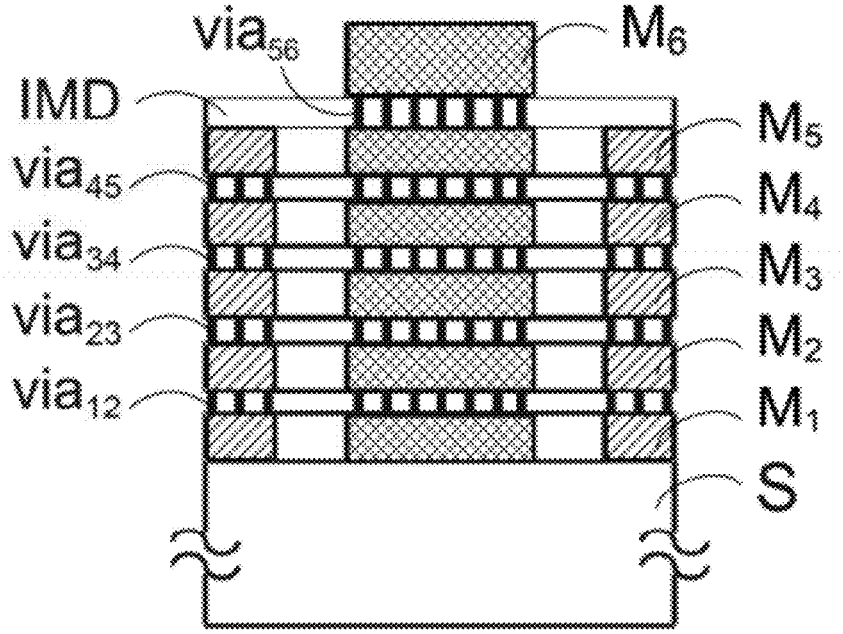
FIG. 2E shows the cross-sectional view from the B-B' line of the preferred CCS structure shown in FIG. 2C.

The unit CCS structure in FIG. 2C a top view shows a periodicity of P, and alternately combines two types of transmission lines shown in FIGS. 2D and 2E to form a quasi-TEM transmission line. FIG. 2D displays a cross-sectional view of the A-A' cut, and clearly shows the well-known microstrip structure, which is locally a capacitive region from the circuit point of view. In contrast, FIG. 2E displays a microstrip with a tuning septa, which can be regarded as an elevated coplanar waveguide (CPW), and is a high impedance inductive region alongside the B-B' cut. Both microminiaturized guiding frameworks support the quasi-TEM mode, alternating to guide the electromagnetic energy, thus allowing arbitrary syntheses of quasi-TEM transmission line with required characteristic impedance.

The central patch with a dimension W and the mesh ground plane of inner slot with a dimension $W_h$ form the complementary conducting surfaces. The term S denotes the width of the connecting arm, thus forming the so-called CCS transmission line. If S=W and $W_h$=0, then the CCS transmission line is regarded as the conventional thin-film microstrip (TFMS), forming a special limiting case in FIG. 2A. Furthermore, the values of the structural parameters, namely P, $W_h$, S, W and the number of metal layer are restricted by the capability of the CMOS technology, which defines the minimum and maximum values of line space, line width and number of metal layer. Hence, the proposed CCS transmission line design is scalable by following the continuing improvement of the semiconductor technology.

Figure 3A:
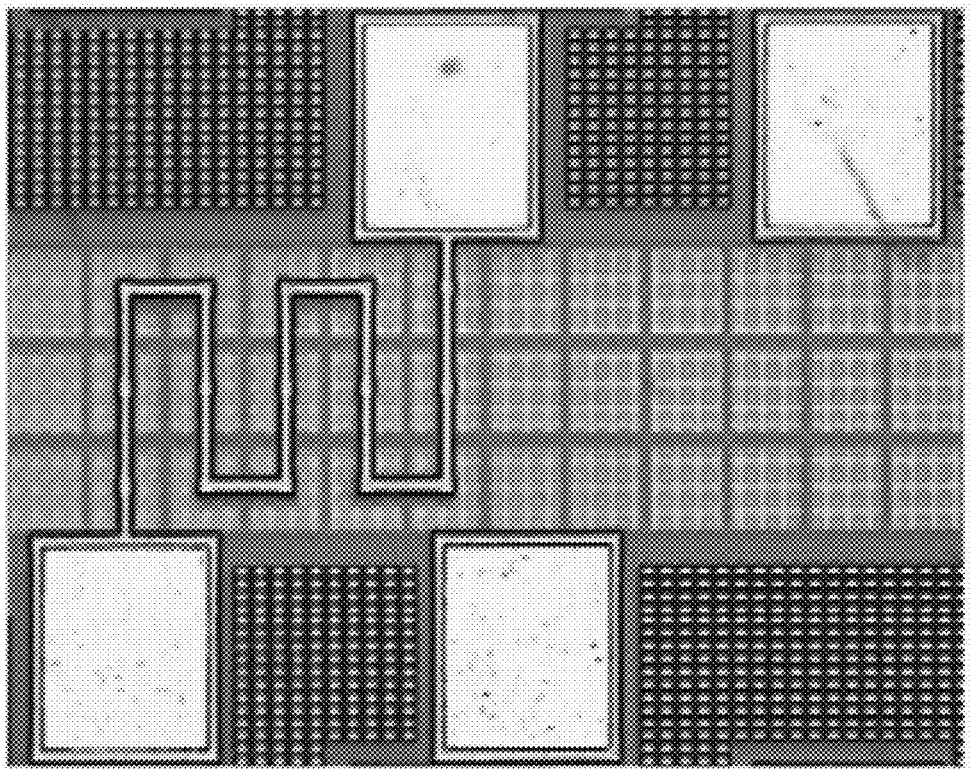
FIG. 3A shows the chip photo of the prototype fabricated by the 0.18 μm 1P6M CMOS technology.

The signal trace is realized by M6, and the mesh ground plane is made of metal layers from M1 to M5. As shown in FIG. 3A, the prototype is designed with the following structural parameters: W=5.0 μm; S=4.0 μm; P=30.0 μm, and $W_h$=28.0 μm. The relative dielectric constants of the inter-media-dielectric (IMD) and silicon substrate are 4.0 and 11.9, respectively. The thickness and conductivity of the silicon substrate are 482.6 μm and 11.0 S/m, respectively. The thickness and resistivity of M6 layer are 2.0 μm and 37 mΩ/sq, respectively. The thickness and resistivity of the layers M1-M5 are 0.55 μm and 79 mΩ/sq, respectively.

The characteristics of the CCS transmission line are gained from the on-wafer measurements. The two-port S-parameters of the CCS transmission line are measured after the short-open-load-through (SOLT) calibration procedures have been carried out to eliminate the parasitics of the signal-ground pads. After the two-port S-parameters are obtained, the complex propagation constant ($\gamma=\alpha+j\beta$, where $\alpha$ is the attenuation constant and $\beta$ is the phase constant) and characteristic impedance Zc are extracted by the well-documented procedures. Parallel to the on-wafer measurements, the CCS transmission line shown in FIG. 3A is also theoretically examined by the commercial software package Ansoft HFSS with the structural and material parameters mentioned above. The simulated results are also compared to those of the extracted results based on the measurements to verify the validity of full-wave electromagnetic simulations.

Figure 3B:
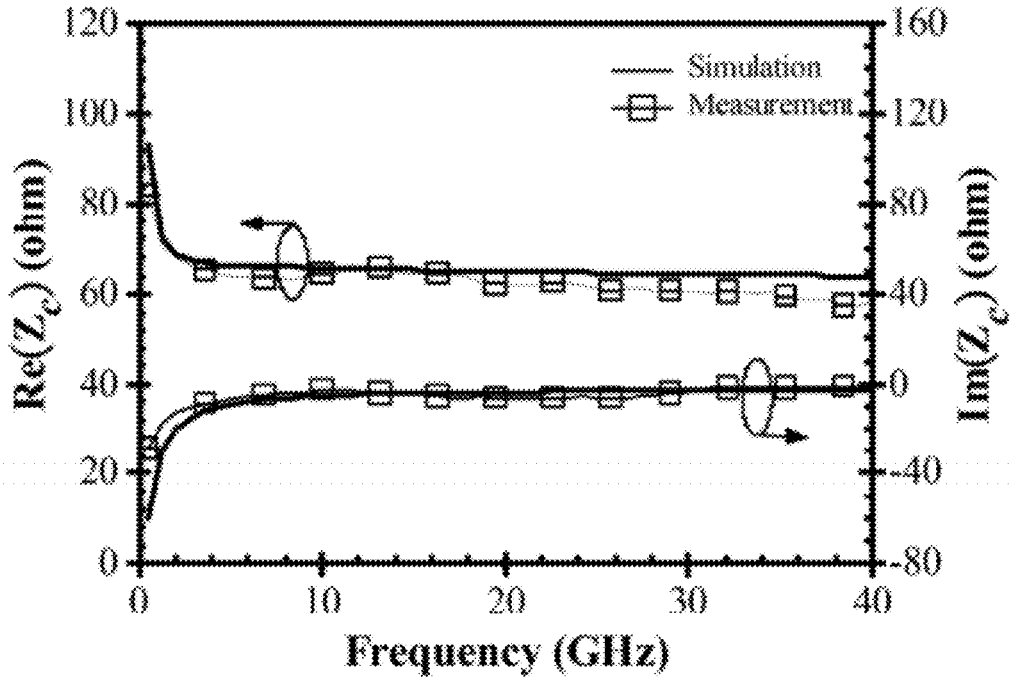
FIG. 3B illustrates the complex characteristic impedance of the prototype shown in FIG. 3A.
Figure 3C:
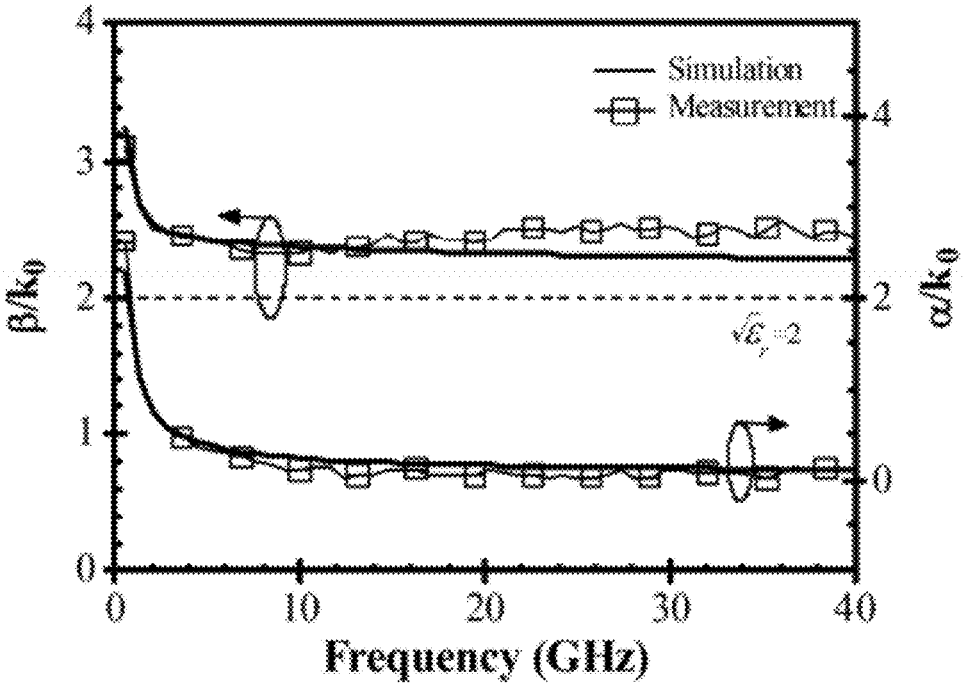
FIG. 3C illustrates the complex propagation constant of the prototype shown in FIG. 3A.

FIGS. 3B and 3C show the comparisons. The maximum deviation of 5.7% in the real part of characteristics impedance Zc is achieved in the range 5.0 GHz to 30.0 GHz. Two imaginary parts of Zc are nearly identical. Furthermore, the measured normalized phase constants, denoted by β/k0, indicate a maximum difference of 8.0% as opposed to the HFSS simulations, and two normalized attenuation constants are nearly identical. The normalized phase constant is 2.37 at 10.0 GHz, which is higher than the theoretical limit $\sqrt{\epsilon_r}$ of the quasi-TEM transmission line. The value $\epsilon_r$ is the relative dielectric constant of the inter-media-dielectric (IMD). Two sets of curves in FIGS. 3B and 3C show excellent agreements in the range 5.0-30.0 GHz, confirming the validity of the on-chip CCS transmission line characteristics using full-wave electromagnetic simulations. The next paragraph presents the analysis of the CMOS CCS transmission line shown in FIG. 2B with various structural parameters by commercial software Ansoft HFSS. The design guidelines for CCS transmission line to synthesize the specific guiding properties are also summarized based on the extensive electromagnetic simulations.

The material parameters are based on standard of 0.18 μm 1P6M CMOS process technology, including the substrate thicknesses and relative dielectric constant, for the HFSS simulations, are set up by following the definitions of the CMOS multilayer synthetic quasi-TEM transmission line. Furthermore, the $M_6$ of all transmission lines in this work are designed with the maximum and minimum line widths of 30.0 μm and 2.0 μm, respectively. The minimum line space of $M_6$ is 2.0 μm. Both of the minimum line width and line space for layers $M_1$-$M_5$ are 0.5 μm. It is to be noted that the design rules for all these metal layers mentioned above conform to the standard foundry rules defined by most manufacturers.

Conversely, before performing the HFSS simulations, the CCS transmission line is meandered by following two basic rules reported in the beginning paragraph. The physical length of the transmission line is 270.0 μm, and the transmission line is meandered by at least 4 bends in each square area. The guiding properties of CMOS CCS transmission line at 10.0 GHz, namely characteristic impedance Zc, slow-wave factor (SWF) and quality factor Q are extracted by the same procedures. The SWF is defined as the normalized phase constant ($\beta/k_0$) of the CCS transmission line, and the Q-factor is the ratio of the phase constant to twice of the attenuation constant. FIG. 4 summarizes the extracted results of varying the corresponding structural parameters P, $W_h$, S, and W.

The metal layer, which is applied to the CCS transmission line design, is highlighted in FIG. 4, which also shows the corresponding metal density, defined as the ratio of the total metal layout area to the TL area. The metal layers with the metal density below and above 30.0% are shown in gray and black, respectively. This invention on CMOS transmission line design is the first to take the process issue of the metal density into consideration. Such process issue, which is specifically defined by the manufacturer, dominated the yield of the CMOS circuit.

The CCS transmission line is identical to the conventional thin-film microstrip (TFMS) when $W_h$=0 and S=W. Conversely, the quality factor Q of the TFMS significantly decreases if the effective thickness between the signal trace and ground plane decreases. Hence, the CCS transmission line in this category applied $M_1$ to the ground plane and $M_6$ to the signal trace to achieve low loss. However, the drawback of the low-loss design is that the metal densities of the rest of the metal layers, from $M_2$ to $M_5$, are zero. Additional chip area is stipulated to accommodate the dummy metal inserts. Additionally, due to the limiting designs of the CCS transmission line reported in FIG. 4, the line space of $M_6$ is set to 2.0 μm to minimize the area of the layout. Based on the closed-form expressions of the limiting designs of CCS transmission line, the $Z_c$ and complex propagation constant γ (γ=α+jβ) are determined by the line width once the material parameters and the thickness between the signal trace and the ground plane are fixed.

Therefore, as indicated in FIG. 4, characteristic impedance Zc increased from 22.7Ω to 88.1Ω when the line width of $M_6$ decreased from 30.0 μm to 2.0 μm. It is to be noted that 30.0 μm and 2.0 μm are the maximum and minimum line widths defined in the simulation for theoretical CCS transmission line design, which limit the $Z_c$ syntheses of the CCS transmission line. Moreover, at 10.0 GHz, the Q-factor of the 88.1Ω CCS transmission line is 2.07, which is over 100% lower than that of the 22.7Ω CCS transmission line. The slow-wave factor (SWF) of five special limiting designs is below 2, which is the theoretical limit of quasi-TEM transmission line on the substrate with a relative dielectric constant of 4.

The CCS transmission lines with $W_h \neq 0$ in FIG. 4 show the following design characteristics. The characteristic impedance Zc can be elevated above 88.1Ω simply by decreasing the ratio of P to $W_h$. P and $W_h$ determine the effective area of the high impedance region in CCS transmission line. Therefore, $Z_c$ can be raised by adjusting P and $W_h$ without varying S and W, which determine the effective line width of CCS transmission line. Conversely, to synthesize a $Z_c$ below 22.7Ω, the metal layer of central patch is vertically extended from $M_6$ to $M_1$. Such an extension enlarges the overlapping area between the signal trace and ground plane, resulting in an increase of capacitance per unit length of the CCS transmission line. By applying the design guidelines to $Z_c$ syntheses, the value of $Z_c$ ranges from 8.62Ω up to 104.0Ω, showing a $Z_c$ ratio of 12.06 (104.0Ω/8.62Ω). This ratio is significantly wider than that of the thin-film microstrip (TFMS) design.

Moreover, the slow-wave factor (SWF) of the CCS transmission line can be raised by the following two design guidelines. The first guideline is to reduce of the ratio of P to $W_h$. This approach is applied to designing the CCS transmission line with $Z_c$ from 88.1Ω to 104.0Ω. As indicated in FIG. 4, the SWF increased from 0.97 to 2.03 when the $P/W_h$ is reduced from 1.14 to 1.02. The second approach is to adopt stacked metal to realize the central patch or mesh ground of the CCS transmission line. In FIG. 4, all the designs of the CCS transmission line with $Z_c$ below 50.0Ω, designed by following the second approach mentioned above, have SWF values exceeding the theoretical limit of quasi-TEM transmission line. Meanwhile, these CCS transmission lines meet the 30.0% metal density requirement for all metal layers and need no additional chip area for filling dummy metal, attaining true miniaturization.

Figure 5:
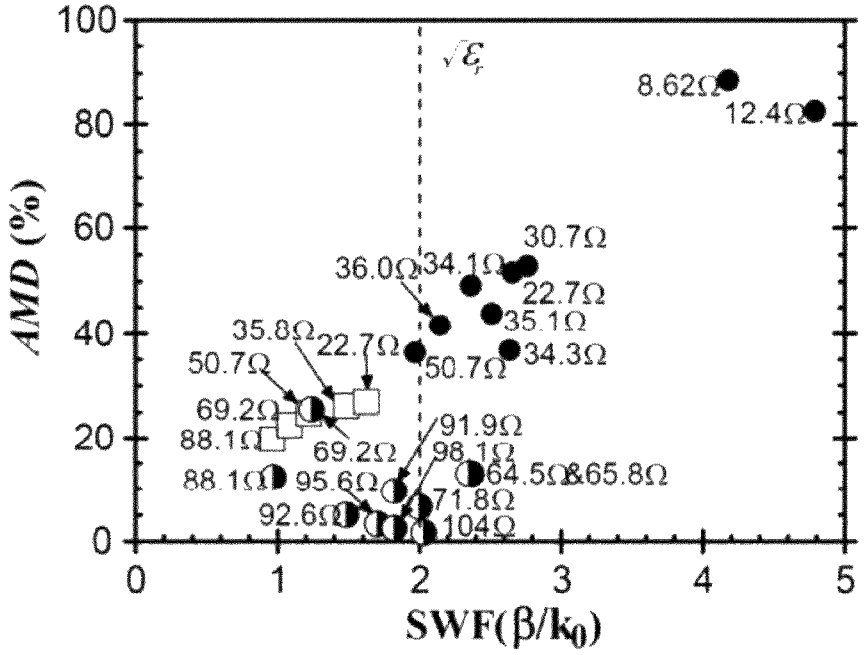
FIG. 5 depicts the average metal density (AMD) against the slow-wave factor (SWF) for CCS transmission lines at 10.0 GHz.

To the best knowledge of the inventors', the proposed design is the first to comply with CMOS metal density rules for designing CMOS transmission line. To discuss these two design approaches in details, FIG. 5 plots the SWF at 10.0 GHz against average metal density for all the CCS transmission line designs in FIG. 4. The average metal density, denoted by AMD in (1), indicates the average value of the metal densities for all six metal layers.

$$AMD = \frac{\sum_{i=1}^{6}\left(\frac{\text{Total metal area at } M_i \text{ layer}}{\text{Area of transmission line}}\right)\times 100\%}{6} \quad (1)$$

As shown in FIG. 5, the CCS transmission lines, which are marked by symbols in hollow squares (□), represent the special limiting designs in the conventional thin-film microstrip (TFMS) when $W_h$=0 and S=W. Additionally, the filled circles (●) indicate that the metal densities of all six metal layers in the CCS transmission line design are higher than or equal to 30.0%. The half-filled circles (◑) mean at least one metal layer with metal density less than 30.0%. The quantity adjacent to the symbols represents the $Z_c$ values of the CCS transmission line design listed in FIG. 4. As shown in FIG. 5, the CCS transmission lines, which are designed by decreasing the ratio of $P/W_h$, show that the slow-wave factor (SWF) increases from 0.97 to 2.03, while the average metal density (AMD) falls from 12.2% to 1.7%.

The designs based on the first approach do not easily meet the required 30.0% metal density. Conversely, in the designs following the second approach, the corresponding SWF increases from 1.97 to 4.79, and meanwhile the AMD also increases from 36.3% to 82.5%. This trend indicates that the second approach can realize a CCS transmission line with high SWF, and that the CCS transmission line design can easily meet the metal density requirement, enabling successful circuit miniaturization.

The design approaches for the CCS transmission line, which can synthesize transmission line with various structure parameters, reveal the fundamental modifications to the design of CMOS transmission line. Furthermore, the CCS transmission lines can be realized in different areas for the same $Z_c$, thus attaining different quality factors (Q-factors). Hence, the following paragraph is devoted to the discussion of the CCS transmission line designs with different area.

Figure 6:
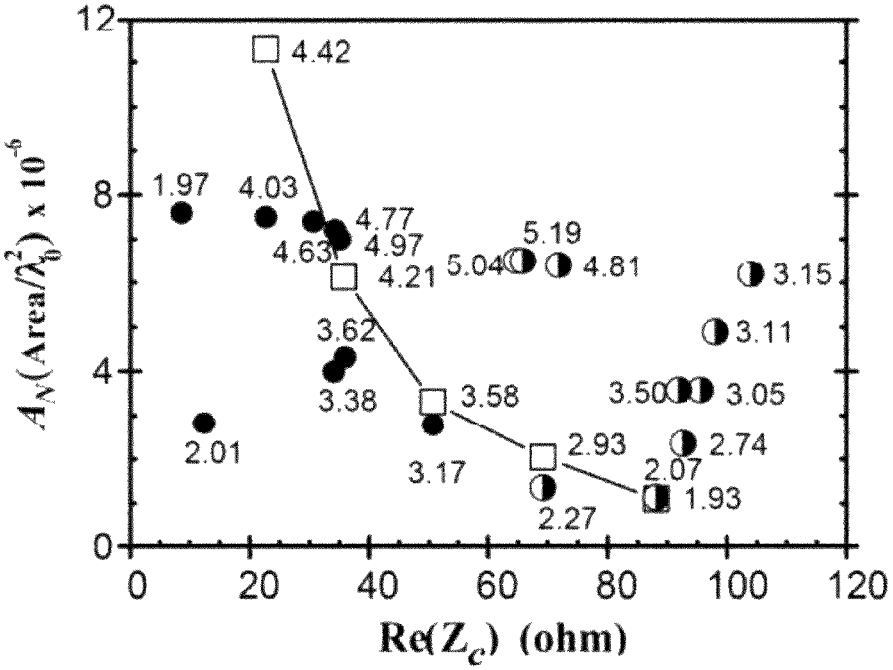
FIG. 6 depicts the normalized area ($A_N$) against real part of the characteristic impedance Zc for 270.0 μm long CCS transmission lines at 10.0 GHz.

Area influence loss of CCS transmission line, FIG. 6 plots the normalized area ($A_N$) versus the characteristic impedance Zc for the CCS transmission line designs listed in FIG. 4. The term $A_N$, defined by (2), represents the ratio of the total occupying area of the meandered CCS transmission line with a fixed length of 270.0 μm to the square of guided wavelength in free space at 10.0 GHz.

$$A_N = \frac{\text{Area}}{(\lambda_0)^2} = \frac{A\cdot(f_0)^2}{c^2} \quad (2)$$

The term $A_N$ in (2) c denotes the velocity of light in free space, and $f_0$ is the operating frequency. As shown in FIG. 6, the quantity adjacent to the symbols is the quality factor Q of the CCS transmission line listed in FIG. 4. The symbols in FIG. 6 are identical to those shown in FIG. 5.

The designs for the special limiting case ($W_h$=0 and S=W) of the CCS transmission line, which are meandered by following two basic rules, one is the length of the signal trace is fixed, two is the CCS transmission line is meandered by at least 4 bends in the square area, set the minimum line space at 2.0 μm to achieve the smallest compact layout area. Therefore, as shown in FIG. 6, the limiting designs of the CCS transmission line denoted by the symbols in hollow squares (□), which can form a virtually continuing curve, show the increase of $A_N$ inversely proportional to the increase of $Z_c$. Such limiting designs are well controlled by only line width (S), and can be scaled down with the continuing improvement of semiconductor process technology.

Conversely, the design approaches presented in CCS transmission line with $W_h \neq 0$, which can synthesize a wider range of $Z_c$ than that of the design approaches in the conventional thin-film microstrip (TFMS) when $W_h=0$ and S=W and provide multiple designs for one specific $Z_c$, lead to different $A_N$ distributions. As shown in FIG. 6, to synthesize $Z_c$ between 88.1Ω and 104.0Ω, the CCS transmission line requires a higher $A_N$ value than the one predicted by the limiting case designs. This trend shows a reduction of the ratio of $P/W_h$ in the CCS transmission line. Additionally, FIG. 6 shows two group designs with different $A_N$ for realizing a 35Ω CCS transmission line.

The first design is the CCS transmission line with P=30.0 μm, which achieve the $A_N$ approaching that of the limiting case. The second design has P=15.0 μm, and results in the $A_N$ below the predicted value of the limiting case. The Q-factor of the CCS transmission line with P=30.0 μm is about 4.87, which is 39.14% higher than that of the CCS transmission line with P=15.0 μm. The Q-factor of the CCS transmission line is relatively proportional to the period of the unit CCS structure. This observation reflects the fundamental physical phenomenon of CCS transmission line design, which is studied in the FIG. 7.

A rectangular cavity in dominate-mode operation indicates that the conductor loss of the cavity is inversely proportional to its volume. If the width, length and height of the rectangular waveguide cavity are all identical, then the cavity is regarded as a cubic resonator, and the conductor loss in the resonator is related only to the quantity of the length since all the CCS transmission lines presented in FIG. 4 are designed on the silicon substrate with a fixed thickness, and meandered in a nearly square area as shown in FIG. 1. Following the concept of the conductor loss in the cubic resonator, this work indicates that the loss of the meandered CCS transmission line with a fixed length is exactly the same as the area-influence loss (AL) with the ratio of the square root of the normalized area ($A_N$) to the quality factor Q. Additionally, as shown in (3), the AL also can be represented by a function of $f_0$, A, C and Q-factor after some algebraic manipulation.

$$AL = \frac{\sqrt{A_N}}{Q} = \frac{\sqrt{\frac{A}{\lambda_0^2}}}{Q} = \frac{\sqrt{A}}{Q\lambda_0} = \frac{f_0\sqrt{A}}{cQ} \tag{3}$$

Figures 7, 8:
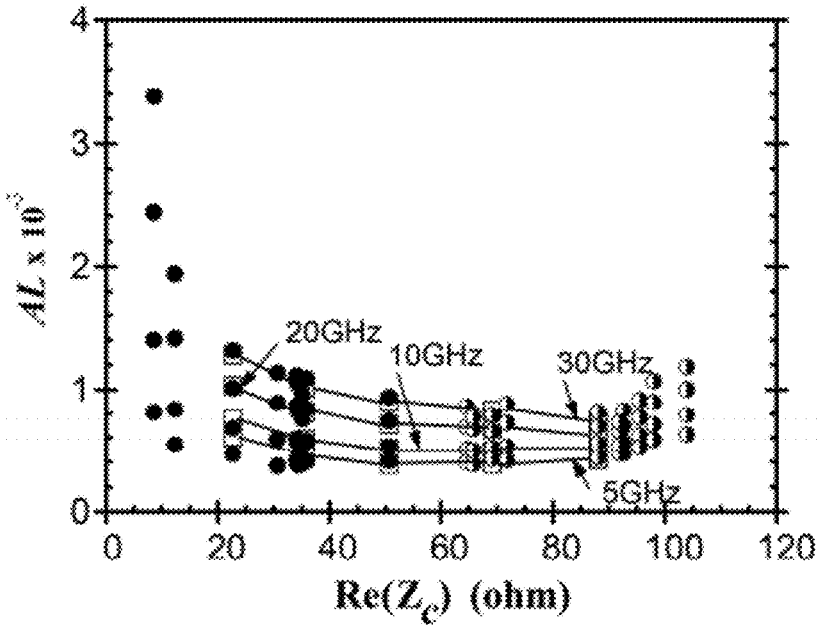
FIG. 7 depicts the characteristic impedance Zc against the area-influence loss (AL) for CCS transmission lines with a length of 270.0 μm.
FIG. 8 shows the design guidelines of CMOS CCS transmission line.

A, which denotes the total occupying area of meandered CCS transmission line with a fixed length, is identical to that in (2), $f_0$ represents the operating frequency of the transmission line, and c is the speed of light in free space. As defined in the beginning paragraph, the length of all the CCS transmission lines in FIG. 4 is set to 270.0 μm. Therefore, FIG. 7 plots the AL versus characteristic impedance Zc for the CCS transmission lines in FIG. 4 at 5.0 GHz, 10.0 GHz, 20.0 GHz and 30.0 GHz. The values of the parameters at 10.0 GHz are listed in FIG. 4, and the values for 5.0 GHz, 20.0 GHz and 30.0 GHz are obtained by following the same analytical procedures reported in the CMOS multilayer synthetic quasi-TEM transmission line except for the operating frequency. The definitions of the symbols, which represent various CCS transmission line designs in FIG. 7, are identical to those in FIG. 5.

Due to the skin-effect, the quality factor Q of the CCS transmission line is proportional to the square root of the frequency. Thus, the area-influence loss (AL) of the 50.7Ω CCS transmission line at 30.0 GHz is $0.89\times10^{-3}$, which is $\sqrt{6}$, $\sqrt{3}$ and $\sqrt{1.5}$ times those at 5.0 GHz, 10.0 GHz and 20.0 GHz, respectively. Such physical trends also can be observed at different CCS transmission line designs with characteristic impedance Zc from 22.7Ω to 88.1Ω.

Furthermore, a close observation of the multiple CCS transmission line designs with a specific $Z_c$ from 22.7Ω to 88.1Ω indicates that the corresponding AL value are nearly identical to each other at the same operating frequency, showing a constant ratio between the square root of the normalized area ($A_N$) to Q-factor in different designs. This result confirms the observation of the two design approaches for 35Ω CCS transmission line in FIG. 6. The CCS transmission line can be designed with a relatively high value of $A_N$ to raise the corresponding Q-factor. Consequently, as shown in FIG. 6, the 22.7Ω CCS transmission line can be designed with $A_N=7.5\times10^{-6}$ for a Q-factor of 4.03, or designed with $A_N=11.28\times10^{-6}$ for a Q-factor of 4.42. Similarly, 69.2Ω CCS transmission line can be designed with $A_N=1.35\times10^{-6}$ for a Q-factor of 2.27, or designed with $A_N=2.04\times10^{-6}$ for a Q-factor of 2.93.

Figure 9A:
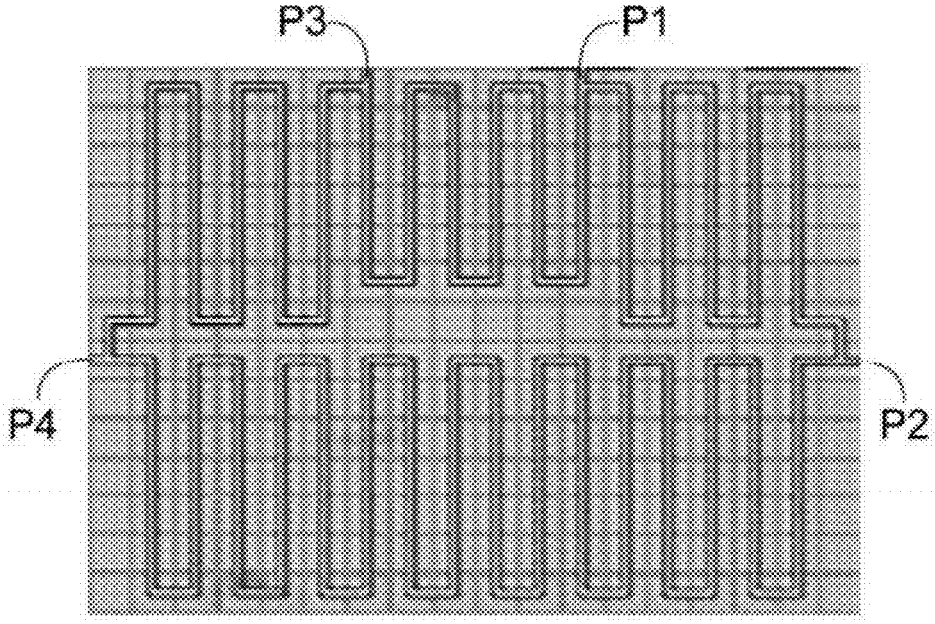
FIG. 9A shows the chip photo of the prototype for a Ka-band CMOS rat-race hybrid transmission line.

The proposed CCS transmission line provides a high flexibility for synthesizing the desired guiding characteristics. By summarizing the design guidelines reported in the before, FIG. 8 shows the universal trends of synthesizing the desired guiding characteristics by adjusting the structural parameters of the CCS transmission line. FIG. 9A shows a 34.3 GHz CMOS rat-race hybrid design incorporating the proposed CCS transmission lines designed according to the guidelines. The operations of the rat-race and its equivalent transmission line network are well-documented. As shown in FIG. 9A, the electrical length between Port 2 (P2) and Port 4 (P4) is three times as great as the quarter-wavelength and the remaining adjacent ports has the length of one quarter-wavelength.

The reference impedance of all four ports is 50.0Ω, and the characteristic impedance of the transmission lines in the entire rat-race is designed as 70.7Ω to establish the equal power-split and power-combination. The CCS transmission line with $Z_c$=71.8Ω is applied to the rat-race realization winding course shown in FIG. 1, and the design is fabricated by standard 0.18 μm 1P6M CMOS process technology. The chip area of the prototype shown in FIG. 9A is 420.0 μm×540.0 μm without the contact pads.

Figure 9B:
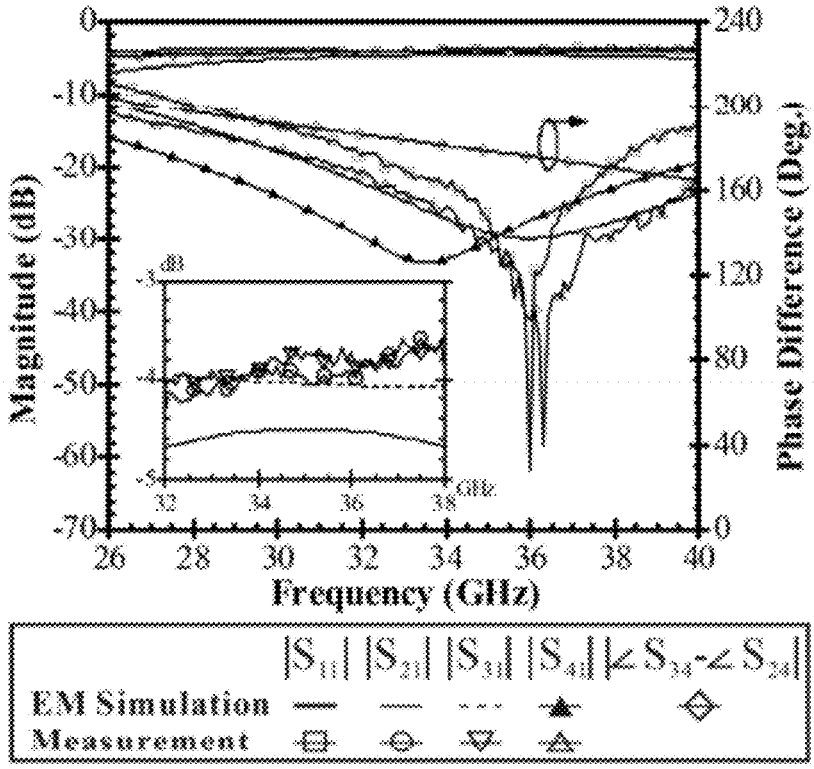
FIG. 9B shows the simulated and Measured results of the prototype shown in FIG. 9A.

The on-chip performances of the prototype are characterized by conducting the same experimental procedures reported in thin-film microstrip and are compared to the theoretical data, which is computed by the full-wave HFSS simulations with the circuit layout in FIG. 9A. FIG. 9B shows the composite plots, revealing good agreements between the measurements and the HFSS simulations. The transmission coefficients, which are shown in FIG. 9B in detail, are less than 4.0 dB from 34.0 GHz to 38.0 GHz, indicating the intrinsic loss of less than 1.0 dB. Additionally, the two transmission coefficients in FIG. 9B are −3.94 dB and −3.75 dB at 34.3 GHz, showing an amplitude in-balance of 0.19 dB. Such results show a nearly-equal power distribution at two output ports of the prototype. The measured input return loss from 32.8 GHz to 38.1 GHz, illustrated by the curve with hollow squares, is higher than 20.0 dB. The measured isolation from 31.5 GHz to 40.0 GHz, illustrated by the curve with hollow triangles, is higher than 20.0 dB and has a maximum value of 58.0 dB at 36.3 GHz. From 31.0 GHz to 37.0 GHz, the phase difference between two output ports is approximately 180°±5°. By referring to the calculation of the area reduction factor (ARF), the prototype in FIG. 9(*a*), which consisted of 14×18 unit CCS structures with P=30.0 μm, achieved ARF of 96.9% at 34.3 GHz.

The design of Ka-band rat-race circuit realized by incorporating CCS transmission lines on the standard 0.18 μm 1P6M CMOS process technology and results the following conclusion. Increasing P of CCS transmission line enhances the quality factor Q of the CCS transmission line. Since P is the main factor managing the occupying area of the CCS transmission line, increasing P simultaneously causes $A_N$ to increase and the area reduction factor (ARF) values to be decreased. These observations validate the design guidelines in FIG. 8. Moreover, the rat-race hybrid designs presented demonstrate that CCS transmission line can systematically miniaturize the transmission line-based circuit with predictable electrical performances. The loss of the CCS transmission line-based circuit is confined to the desired area, and the CCS transmission line circuit designed by different approaches produced different ARF values for circuit miniaturization.

The CCS transmission line can be designed with a wide range of characteristic impedance, high slow-wave factor and the satisfaction of the metal density requirement. Additionally, when the physical length is fixed, the ratio of the CCS transmission line area to its corresponding Q-factor approaches a constant and can be applied to estimating the cost of loss for the CMOS circuit miniaturization.

Other modifications and variations are possibly developed in light of the above demonstrations. It is therefore to be understood that within the scope of the appended claims the invention would be practiced otherwise than as specifically described herein. Although specific embodiments have been illustrated and described herein, it is obvious to those skilled in the art that many modifications of the present invention may be made without departing from what is intended to be limited solely by the appended claims.

What is claimed is:

1. A complementary-conducting-strip structure, comprising:

a substrate;

a transmission part formed on said substrate, said transmission part consisted of M metal layers and at least one connecting arm extending from at least one said M metal layers to connect to an adjacent complementary-conducting-strip structure, said M metal layers interlaminated with M−1 dielectric layer(s) perforating a plurality of first metal vias to connect said M metal layers, wherein M≧2 and M is a natural number; and a frame part formed on said substrate, said frame part surrounding said transmission part and consisted of M−1 metal frame(s), said M−1 metal frame(s) interlaminated with M−2 dielectric frame(s) perforating a plurality of second metal vias to connect said metal frames.

2. The complementary-conducting-strip structure as described in claim 1, wherein said frame part is used as a ground plane.

3. The complementary-conducting-strip structure as described in claim 1, wherein said transmission part is for transmitting a signal.

4. The complementary-conducting-strip structure as described in claim 1, wherein said at least one connecting arm comprises two connecting arms located at opposite sides or adjacent sides of said M metal layers.

5. The complementary-conducting-strip structure as described in claim 1, wherein said at least one connecting arm comprises three connecting arms formed into a T-shape.

6. The complementary-conducting-strip structure as described in claim 1, wherein said at least one connecting arm comprises four connection arms on four sides of said M metal layers.

7. The complementary-conducting-strip structure as described in claim 1, wherein said M−1 dielectric layers are correspondingly at the same level as said M−2 dielectric frames and merge with each other into dielectric planes respectively.

8. The complementary-conducting-strip structure as described in claim 1, wherein the complementary-conducting-strip structure is included within a plurality of complementary-conducting-strip structures that are arrayed in rows and columns to form a larger two-dimensional waveguide structure.

9. The complementary-conducting-strip structure as described in claim 1, wherein the complementary-conducting-strip structure is included within a plurality of complementary-conducting-strip structures that are connected to form a two-dimensional meandering transmission line.

10. The complementary-conducting-strip structure as described in claim 9, wherein a characteristic impedance and a quality factor of said two-dimensional meandering transmission line can be altered by adjusting parameters of said complementary-conducting-strip structure.

11. The complementary-conducting-strip structure as described in claim 10, wherein the parameters of said complementary-conducting-strip structure comprise a width of said transmission part, inner and outer widths of said frame part, a width of at least one said connecting arm, and the quantity of said metal layers.

12. The complementary-conducting-strip structure as described in claim 1, wherein said transmission part and said frame part are formed by using a complementary-metal-oxide-semiconductor process.

* * * * *